United States Patent [19]

Buck, Jr.

[11] 4,009,546

[45] Mar. 1, 1977

[54] PRE-ASSEMBLED UNITARY BAY WINDOW CONSTRUCTION

[75] Inventor: Elwood W. Buck, Jr., Pasadena, Calif.

[73] Assignee: D G Shelter Products Company, City of Industry, Calif.

[22] Filed: Oct. 1, 1975

[21] Appl. No.: 618,518

[52] U.S. Cl. ..... 52/201; 47/68; 52/27; 52/302

[51] Int. Cl.[2] ..... E06B 1/38

[58] Field of Search ..... 52/201, 198, 73, 97, 52/27, 302; 47/36, 40; 98/96; 206/423; 160/88

[56] References Cited

UNITED STATES PATENTS

| | | | |
|---|---|---|---|
| 400,605 | 4/1889 | Scholfield | 52/201 |
| 2,020,495 | 11/1935 | Bayley | 52/201 |
| 2,074,872 | 3/1937 | Thorin | 47/40 |
| 2,156,746 | 5/1939 | Steinmetz | 47/40 |
| 2,810,941 | 10/1957 | Mainieri | 52/201 |
| 2,820,991 | 1/1958 | Poole | 52/73 |
| 2,834,441 | 5/1958 | Mims | 47/40 |
| 3,074,125 | 1/1963 | Miller | 52/201 X |
| 3,148,479 | 9/1964 | D'Amato | 52/201 X |
| 3,319,378 | 5/1967 | Andrews | 47/40 |
| 3,879,891 | 4/1975 | Jones | 47/36 |

FOREIGN PATENTS OR APPLICATIONS

| | | | |
|---|---|---|---|
| 16,509 | 10/1928 | Australia | 52/201 |
| 6,082 | 12/1911 | United Kingdom | 47/36 |

*Primary Examiner*—Price C. Faw, Jr.
*Assistant Examiner*—Leslie Braun
*Attorney, Agent, or Firm*—Poms, Smith, Lande & Glenny

[57] ABSTRACT

A pre-assembled unitary bay window construction having a plurality of window frames with related sash held in assembled relation by a peripheral frame structure, the frame structure being receivable in a wall opening and secured therein. The unitary window construction is prefabricated and may be handled as a unit. When used at a kitchen patio window above a kitchen counter, the counter space is extended outwardly, is protected from outside weather, yet can be utilized as an outside counter for eating purposes.

2 Claims, 5 Drawing Figures

PRE-ASSEMBLED UNITARY BAY WINDOW CONSTRUCTION

BACKGROUND OF THE INVENTION

Patio living generally includes the use of outdoor patio space for recreational activities and for serving of food and drink. In many homes a kitchen is located near the patio and sometimes a window may be provided in the wall between the kitchen and the patio area. In some homes, there has been a desire to pass food and drink directly from the kitchen to the patio and for this purpose exteriorly exposed counters were provided at the sill of a kitchen window if such a window existed. Such exterior counters were not aesthetically pleasing because such counters usually comprised a shelf projecting outwardly from the exterior wall and window. Such exterior shelves were subjected to outside weather conditions throughout the year and in winter collected snow, dirt and rain and were generally unpleasant to view through the kitchen window. During summer months such an exterior shelf collected dust, dirt and other debris and required continual cleaning otherwise the shelf became an eyesore.

SUMMARY OF INVENTION

The present invention contemplates a novel construction of a bay window which in effect extends the interior kitchen counter to the window plane to provide a counter which will serve all of the purposes of the exterior counter and yet avoid all of the disadvantages of such an exterior counter. The present invention contemplates such a counter extension made in connection with a window construction which enhances the exterior appearance of the exterior wall and which also enhances the interior appearance of the kitchen. The invention further contemplates a prefabricated, pre-assembled window construction which may be handled as a unit and installed over a wall opening without requiring special construction of the building structure at the wall opening.

The primary object of the present invention is to provide a novel, pre-assembled unitary window construction adapted to be installed in a wall opening to enhance the appearance and utility of the area about the wall opening particularly if the wall opening is between a kitchen and patio area.

An object of the present invention is to provide a unitary window construction which is readily supported within a wall opening and readily installed therein.

Another object of the present invention is to disclose and provide a novel pre-assembled window construction of bay or oriel type wherein a plurality of angularly disposed window frames are supported and held in assembly by a peripheral frame means so constructed and arranged as to be readily installed in a wall opening without modification of the wall construction.

A further object of the present invention is to disclose and provide a novel window construction wherein normally interior counter space is extended outwardly beyond the plane of a wall opening to enhance the interior appearance of the room. The invention contemplates that the extension of the room may include planter means for desired bedding plants.

A still further object of the present invention is to provide a novel construction and arrangement of a pre-assembled unitary window having angularly disposed window frames and peripheral frame means including a roof structure which are adapted to be readily installed in a wall opening of an exterior building wall.

Various other objects and advantages of the present invention will be readily apparent from the following description of the drawings in which an embodiment of the invention is shown.

IN THE DRAWINGS

Figure 1:
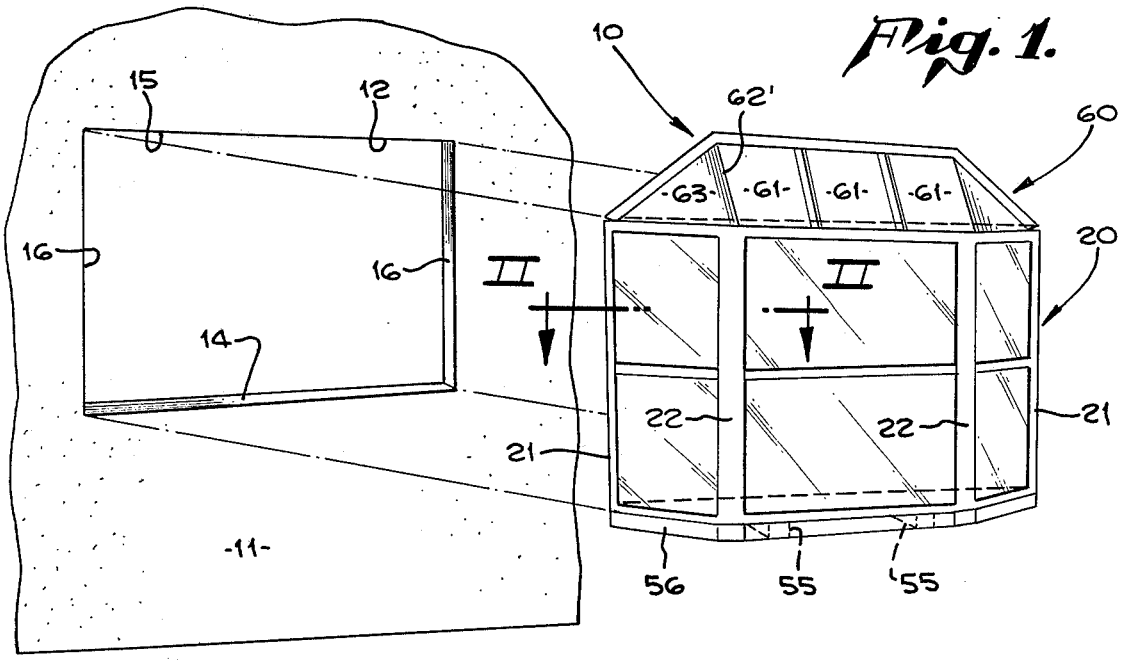
FIG. 1 is an exploded perspective view of an exterior building wall having a framed opening and a pre-assembled unitary window construction of this invention adapted to cover said opening.

In FIG. 1 there is shown a pre-assembled unitary window construction generally indicated at 10 embodying this invention. Window construction 10 is prefabricated and adapted to be handled as a unit and installed against an exterior wall 11 of a building having a framed wall opening 12 of standard or any preselected size. Wall opening 12 is defined by a bottom frame member 14, a top frame member 15 and side frame members 16. The frame members 14, 15 and 16 of the wall opening 12 are illustrated as made of wood and is well known construction for exterior walls of buildings. It will of course be understood that exterior wall 11 may be an exterior wall of a mobile home and the frame members 14, 15 and 16 may be of metal.

Unitary window construction 10 is particularly adapted for use at a kitchen window opening to a patio or other outside recreational area. It is intended that the window construction 10 extend or project an interior counter surface in a kitchen outwardly and beyond the exterior surface of wall 11 so that the extended surface may be used as a counter or a protected counter area across which food may be passed through the windows of the window construction. The utility of the unitary window construction 10 will be further understood from the following detailed description thereof.

Window construction 10 comprises a window means generally indicated at 20 which includes a plurality of window frames 21 and 22, frames 22 providing a central window opening and frames 21 providing side window openings disposed at an angle to the central window frame 22. In this example, the included angle defined by frame 22 and an adjacent frame 21 is a selected obtuse angle. It will be understood that such an included angle may be 90 degrees is desired. The width dimensions of the window frames 21, 22 may be suitably proportioned with respect to the wall opening 12.

Window frame 22 may comprise side jambs 24 and header 25 may be made of suitable extruded metal such as aluminum. Sill member 26 may also be made of a suitable aluminum extrusion. The jambs 24, header 25 and sill member 26 provide suitable peripheral channels cooperating with double hung window sash 27 and 28 and a screen 29. Bottom sash 28 is adapted to be moved vertically to open the lower part of the window.

Window frames 21 include an inboard jamb 24' of section similar to jamb 24 of the frame 22 and an outboard or outer jamb 30 at the side of the window construction. Each outer jamb 30 is provided with a bent flange member 31 lying in a plane parallel to the plane of the wall opening 12. The header and sill of each side frame 21 may be similar to the header 25 and sill 26 of the central frame 22.

A vertical column member 33 of suitable cross-section interconnects adjacent jambs 24 and 24'. Member 33 includes a central web 34, an interior flange 35 provided with in-turned edge portions 36 providing an inwardly facing recess which may be filled with a decorative wood. An exterior flange 34 provides with an internal flange 38 a longitudinally extending space for reception of flanges 39 and 39' provided on the jambs 24, 24'. The vertical column member 33 and the jambs 24, 24' may be secured together as by suitable metal screws or other fastening means.

Preferably, the sill member 26 and header member 25 are continuous across the frames 21 and 22 and the ends of the vertical member 33, a suitable angular cut-out being made in the metal extrusion to provide the angular disposition of the side window frames 21 and central window frame 22.

The side window frames 21 may also include double hung window sash adapted to be slidably vertically movable to open and close the window in known manner.

A peripheral frame means generally indicated at 40 is provided for holding and retaining the window frames 21, 22 in desired angular relation, for rigidifying the window construction, and for providing a means for attachment of the window construction 10 to the framed wall opening 12. Peripheral frame means 40 includes a top plate 41 and a bottom plate 42 having a polygonal configuration such that the outer edges 43 and 44 respectively of the plates 41 and 42 may snugly seat against an upturned rib 45 and a downturned rib 46 respectively of the header member 25 and sill member 26. Interior edges 47 and 48 respectively of plates 41 and 42 lie in a planar zone which when installed, corresponds to the plane of the inner edges of wall opening 12 so that interior longitudinal portions of the plates 41 and 42 overlie the frame members 14 and 15.

Along each side of the window construction the outer flanges 31 of the window frames 21 are abutted against side frame members 50 which have an interior edge 51 lying in the planar zone defined by the interior edges 47 and 48 of plates 41, 42. The peripheral frame means comprising the top and bottom of plates 41, 42 and side members 50 may be secured to the window frames 21, 22 by suitable fastening means such as screws and the plates 41, 42 and side members 50 may be secured together at their adjoining edge portions by suitable nails or screws or other fastening means.

The peripheral frame means together with the joining of the window frames 21, 22 by the vertical column members 33 provides a pre-assembled, pre-fabricated unitary assembly which may be readily lifted and placed against wall 11 at the wall opening 12 for securement thereto by usual means such as nails driven through plates 41, 42 into frame members 15, 14 and through side members 50 into frame members 16. It will be noted in FIG. 3 plate 42 overhangs the exterior wall 11 and the bottom plate 42 is further supported and made more rigid by a pair of spaced joists 55 and an outer skirt member 56.

The unitary window construction 10 also includes a suitable roof structure generally indicated at 60. Roof means 60 may comprise known sheet metal roof construction including a plurality of rectangular sheet metal panels 61 joined along interlocking edge ribs 62 and triangular end sheet metal sections 63 joined along their edges to their adjacent rectangular section 61 in similar manner as at 62'. The lower edges of the sections 61 and 63 are provided with an inturned horizontal lip 64 which underlies an outwardly directed flange 65 of the header 25. The upper edges of the sheet metal sections 61 and 63 are provided with an upturned L section having a vertical flange 66 for seating against the exterior surface 67 of wall 11 above the wall opening 12. Roof means 60 is secured by suitable sheet metal screw bolts to the flange 65 and is essentially self-supporting because of its triangular sections 63. When the window construction is installed, the edge flanges 66 may be secured by suitable nails or screw bolts to the wall 11 including securement to studs in the wall. The roof means 60 may be differently shaped and configured depending upon the architectural effect which is desired to be created. Preferably the roof means is prefabricated and pre-assembled with the window construction.

Figure 2:
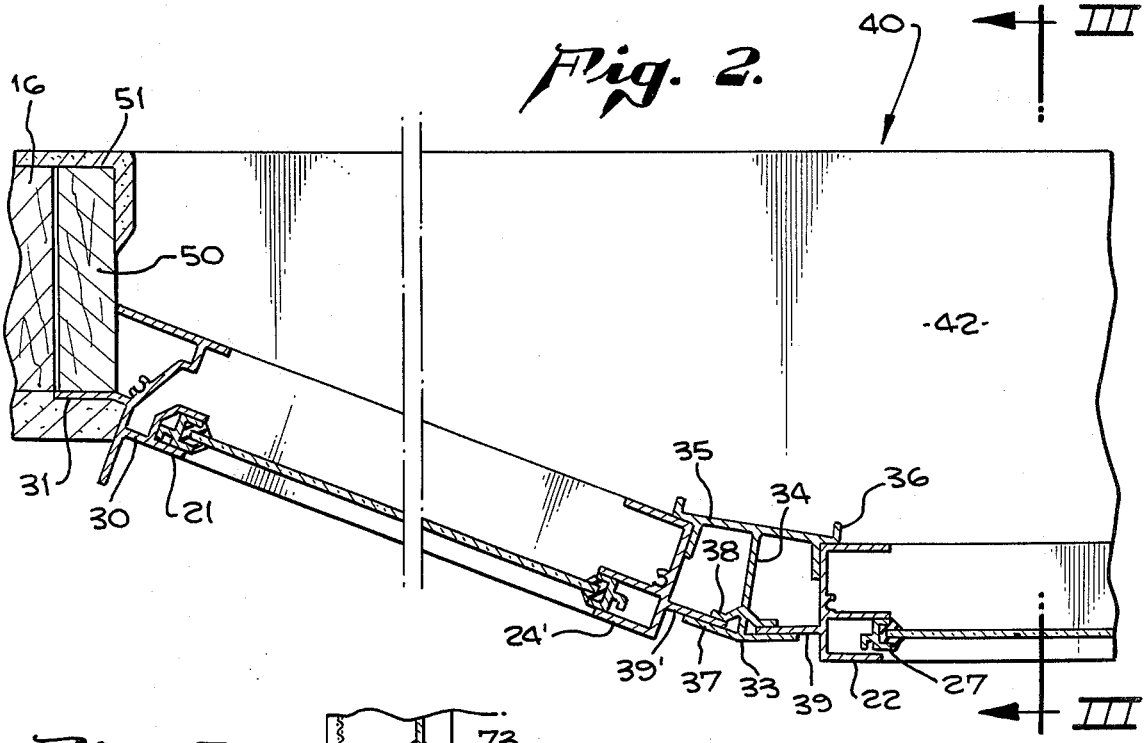
FIG. 2 is an enlarged fragmentary sectional view taken in the horizontal plane indicated by line II—II of FIG. 1.
Figure 5:
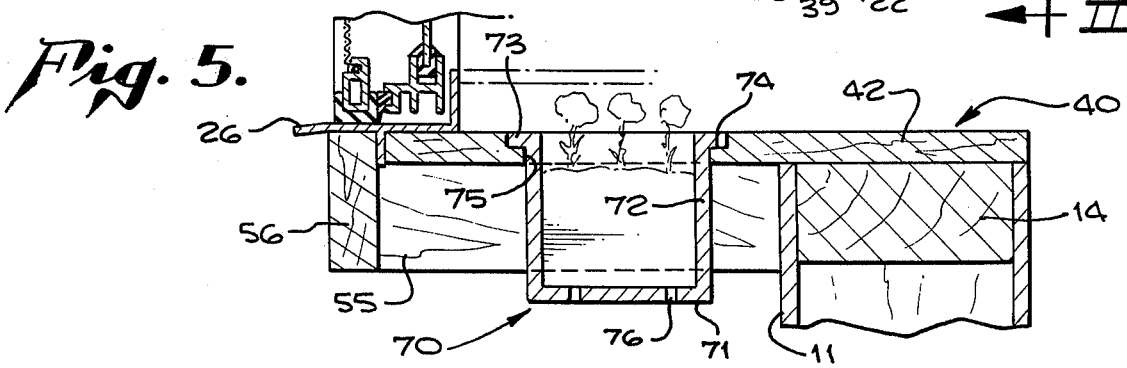
FIG. 5 is an enlarged fragmentary sectional view taken in the vertical plane indicated by line V—V of FIG. 4.
Figures 3, 4:
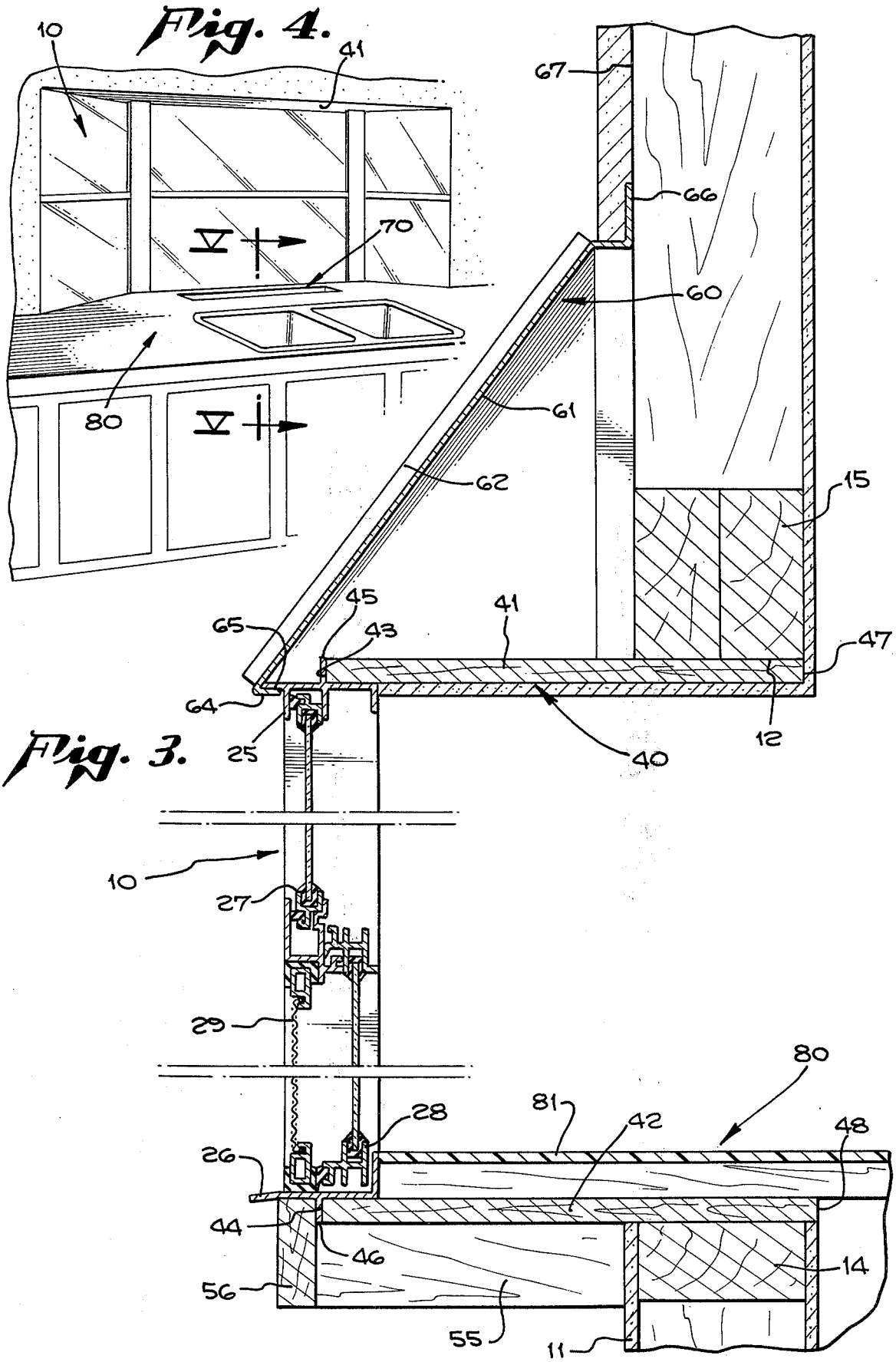
FIG. 3 is a fragmentary enlarged sectional view taken in the vertical plane indicated by line III—III of FIG. 2.
FIG. 4 is an interior perspective view of the window construction shown in FIG. 1 and including a planter means.

In the arrangement of the bottom plate 42 shown in FIGS. 1–3 inclusive, it will be noted that the plate 42 provides a base which is seated upon the bottom frame members 14 of the wall opening 12 and that the weight of the window construction is transferred to the wall 11 through frame member 14. The bottom plate 42 extends outwardly from the exterior surface of wall 11 and in some instances it may be desirable to provide a planter cavity means generally indicated at 70 for decorative effects interiorly of window frame 22. Planter cavity means 70 shown in FIG. 5 may comprise an elongated channel member 71 having side walls 72 provided with out-turned edges 73 adapted to be seated on a peripheral ledge 74 formed at an opening 75 cut in the plate 42. The bottom wall of the planter cavity means 72 may be provided with suitable drainage openings 76 for drainage of excess water in the channel member 71. It will be noted that the drainage openings 76 and the channel 71 are spaced away from the exterior surface of wall 11 so that any dripping will not discolor or mar wall 11 and may be suitably carried away by the patio floor surface or other suitable drainage means. The planter cavity means 70 may of course be used for other purposes if desired. As shown in FIG. 4 the planter cavity 70 located in front of the central window and if planted in suitable flowers, will provide a decorative interior floral effect which is protected from outside weather conditions.

As best seen in the sectional view of FIG. 3, interior surfaces of the wall 11 and the plates 41 and 42 may be suitably covered with plasterboard, paneling, or other surface covering. When the window construction is installed in a kitchen in front of a kitchen sink, the counter of the kitchen sink generally indicated at 80 will be extended outwardly by the counter extension 81 beyond the plane of the wall opening 12 and provide additional counter space which is protected from outside conditions.

Such counter space as provided by the counter extension 81 may serve as a counter for passing food through the window for patio use or may serve as counter space toward which suitable counter stools may be drawn for comfortable eating on the counter extension 81.

It will be readily apparent that the protectability of the counter extension 81 together with its aesthetic appeal of extending interior counter space outwardly provides a novel, useful, decorative arrangement particularly for outside patio use. It will of course be understood that while the example described has often referred to its relation to a kitchen or a kitchen counter, the unitary pre-assembled window construction 10 may be readily adapted to any other wall opening for extending the interior space outwardly and for collecting light from sides of such a wall opening.

Various modifications and changes may be made in the specific construction of the peripheral frame means and the fenestration of the window construction and all such changes and modifications coming within the spirit of this invention and within the scope of the appended claims are embraced thereby.

I claim:

1. A window-counter construction comprising:

a pre-assembled unitary window means having a plurality of window frames positioned in angular relation;

each of said window frames including a sill member, a head member, and vertical side members;

adjacent side members of adjacent window frames being interconnected by a vertical jamb member;

exterior side members of said window frames including a vertically extending flange;

and peripheral frame means including top and bottom plate members secured to said frames and said intermediate jamb members, and side frame members secured to said flanges on said exterior side window frame members;

the interior edges of said top and bottom plate members and peripheral side frame members lying in a planar zone adapted to correspond to the planar zone of a framed opening in a building wall;

roof means covering said top plate member and having edges lying in said planare zone for abutting contact against an exterior surface of a wall;

and counter surface means interiorly of said peripheral frame means and extending over said bottom plate member to said window frames for providing a counter surface extension into said window means.

2. In a bay window kitchen counter construction including a plurality of window frames angularly related to provide a bay window, the provision of:

peripheral frame means joining and holding said window frames in assembled relation in the selected angular relation;

means including wall members defining a wall opening for reception of said peripheral frame means;

and counter means extending interiorly of said wall members and said wall opening;

said counter means including a counter extension extending through said wall opening and to said angularly related window frames for providing a counter surface extension to said window frames;

said peripheral frame means including a bottom plate member adapted to be supported by one of said wall members defining the bottom of said wall opening;

said bottom plate member having an opening adapted to receive and support a cavity means exteriorly of said wall members;

said counter extension having an opening therein aligned with said cavity means.

* * * * *